US006089725A

United States Patent [19]

Chen

[11] Patent Number: 6,089,725

[45] Date of Patent: Jul. 18, 2000

[54] CEILING FAN

[76] Inventor: Li-Su Chen, P.O. Box 196, Fung Yung, Taichung, Taiwan

[21] Appl. No.: 08/512,492

[22] Filed: Aug. 8, 1995

[51] Int. Cl.[7] ..... F21V 33/00

[52] U.S. Cl. ..... 362/96; 362/149; 362/216; 362/225; 362/406; 416/5

[58] Field of Search ..... 362/96, 147, 149, 362/216, 405, 406, 225; 416/5

[56] References Cited

U.S. PATENT DOCUMENTS

| | | | |
|---|---|---|---|
| 2,201,153 | 5/1940 | Brown | 362/96 |
| 4,342,073 | 7/1982 | Ranten | 362/96 |
| 4,402,649 | 9/1983 | Laurel | 416/5 |
| 5,097,398 | 3/1992 | Dye | 362/149 |
| 5,151,011 | 9/1992 | Rezek | 416/5 |
| 5,302,083 | 4/1994 | Bucher et al. | 416/5 |
| 5,404,284 | 4/1995 | Davis, Jr. | 362/96 |

*Primary Examiner*—Alan Cariaso

[57] ABSTRACT

A ceiling fan includes a motor having a center shaft. A control box is secured to said lower end of said shaft. An upper shell is secured to the control box for receiving the control box and the motor. A lower shell and a frame are secured to the control box. The frame has a cross shape having a number of ends for supporting a number of light tubes. The light tubes are engaged around said upper shell. A lamp shell includes a multi-circle step having two circular surfaces for supporting two circular light tubes.

2 Claims, 8 Drawing Sheets

CEILING FAN

BACKGROUND OF THE INVENTION

1. Field of the Invention

The present invention relates to a ceiling fan, and more particularly to a ceiling fan having light bulbs protruding outward of the shell.

2. Description of the Prior Art

A typical ceiling fan is shown in FIG. 1 and is designated with reference numeral 10 and comprises a main lamp 111 and a number of auxiliary ceiling lamps 14. The ceiling fan 10 includes a main lamp socket 11 for attaching the main lamp 111 thereto, a circuit control box 12 disposed above the main lamp socket 11, and a control motor 13 secured to the bottom portion of a rod 131 and engaged in a decorating lamp shell. The top of the rod 131 is secured to the ceiling or secured to a frame by means of a suspension socket. The auxiliary lamps 14 extend downward and outward from the upper half of the main lamp. The fan leaves 15 are secured to the bottom of the motor 13.

The whole conventional ceiling fan comprises a large length which is too large to be installed in the interior space of an ordinary Japanese room and which may not be easily installed to the ceiling.

In view of the above-mentioned drawbacks of the conventional lamp, the present invention has arisen to decrease the ceiling fan size.

SUMMARY OF THE INVENTION

The primary objective of the present invention is to provide a ceiling fan having a decreased size.

DETAILED DESCRIPTION OF THE PREFERRED EMBODIMENT

Figure 1:
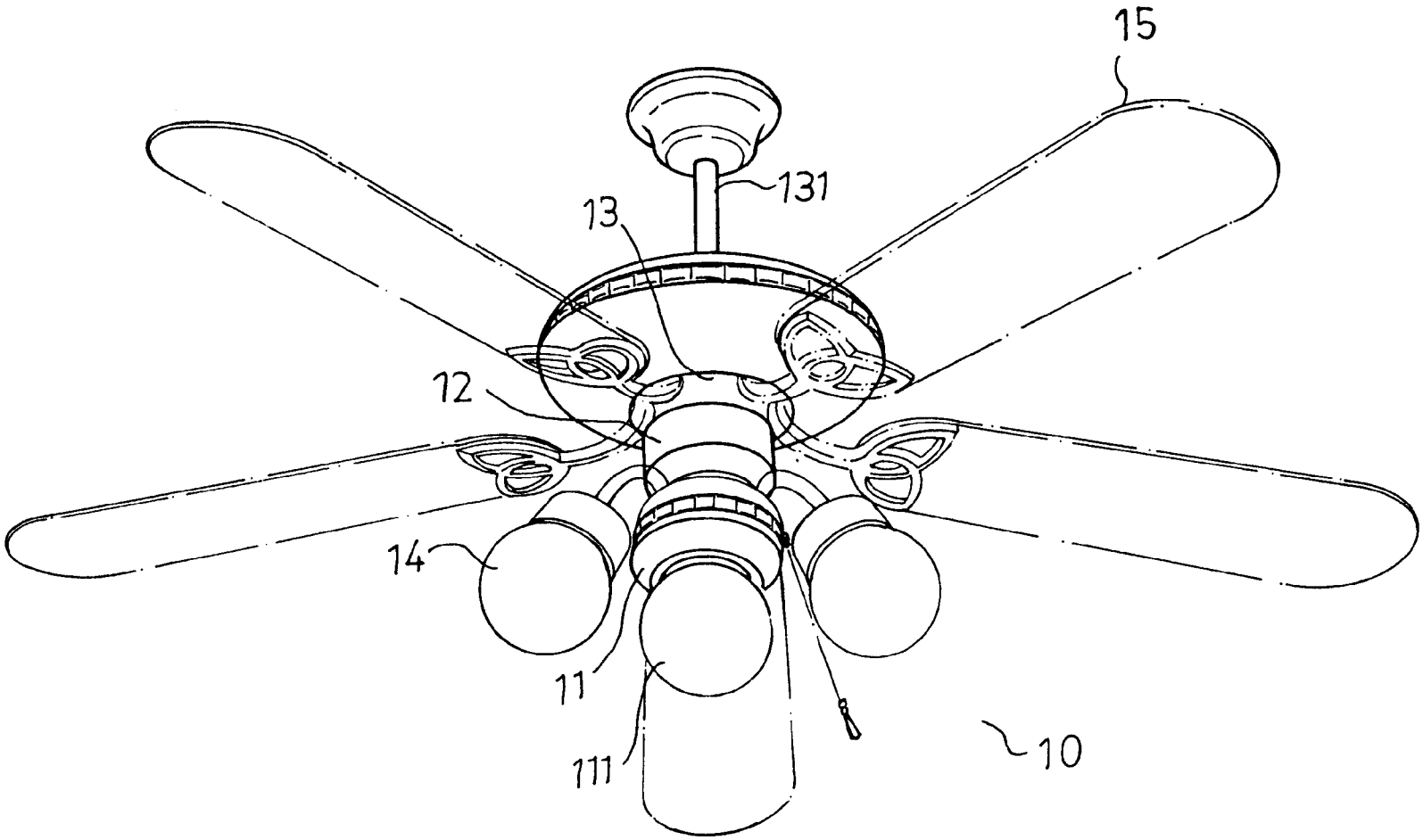
FIG. 1 is a perspective view of a conventional ceiling fan.
Figure 2:
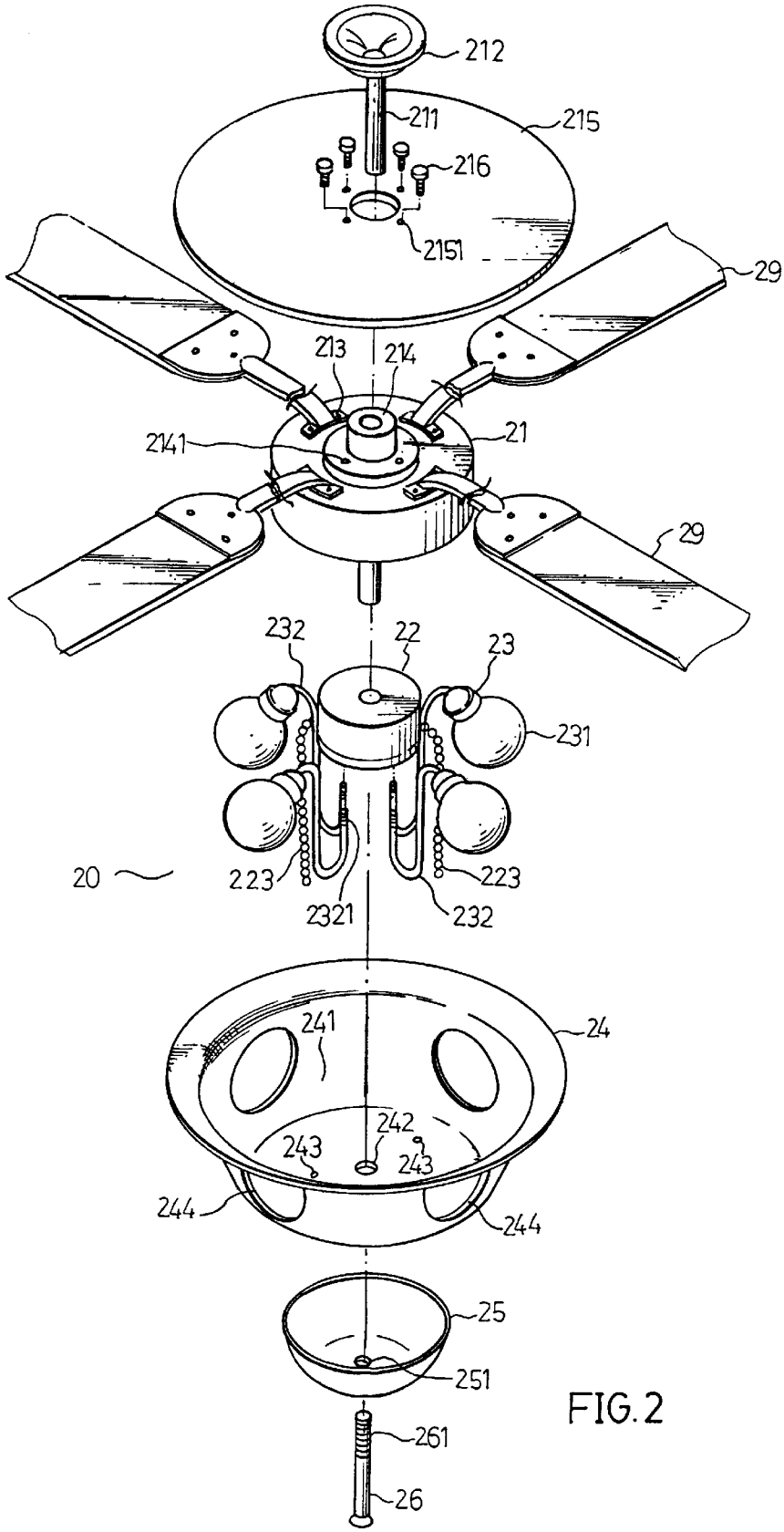
FIG. 2 is an exploded view of a ceiling fan in accordance with the present invention.
Figure 3:
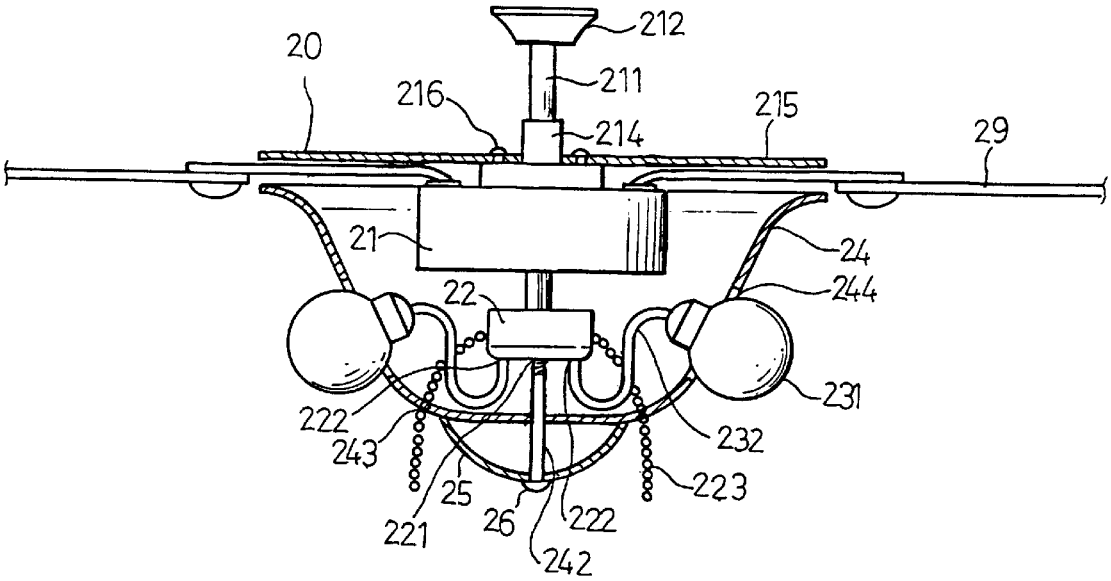
FIG. 3 is a partial cross sectional view of the ceiling fan as shown in FIG. 2.

Referring to FIGS. 2 and 3, illustrated is a ceiling fan 20 of the present invention which comprises a motor 21 having a shaft 211 extended through the center portion. The shaft 211 is secured to a suspension socket 212 for fixing to the ceiling. A control box 22 is secured to the lower end of the shaft 211. The motor 21 includes a number of holes formed in the peripheral portion for securing fan leaves 29 thereto so as to allow the fan leaves 29 to be rotated by the motor 21. An upside down T-shaped body 214 is provided on top of the motor and has a number of screw holes 2141 formed therein. A cover 215 is engaged on the shaft 211 and is secured to the body 214 by screws 216 which engage through the holes 2151 of the cover 215 and engage with the screw holes 2141.

The control box 22 includes a number of holes 222 provided around a center hole 221 and having inner thread for engaging with outer thread 2321 of a number of rods 232 such that the rods 232 may be secured to the control box 22. A number of lamps 23 are secured to the rods 232 and each includes a lamp body 231. The control box 22 includes one or more pulling cord 223 secured thereto for controlling purposes.

A lamp shell 24 includes a inner space 241 for receiving the motor 21 and the control box 22 therein. The fan leaves 29 are provided above the lamp shell 24 and extending outward of the lamp shell 24 such that the rotation of the fan leaves 29 will not be interfered by the lamp shell 24. The lamp shell 24 includes two holes 243 formed in the bottom for allowing the pulling cords 223 to be engaged therethrough and includes a center hole 242. The lamp shell 24 includes a number of openings 244 formed in the side portion.

The lamp bodies 231 of the lamps 23 are engaged in and partially extended outward of the lamp shell 24 through the openings 244.

A main lamp shell 25 is semicircle and transparent and includes a center hole 251. A connecting element 26 is engaged through the center holes 251, 242 and has an outer thread 261 for engaging with the center hole 221 of the control box 22 so as to secure the main lamp shell 25 to the lamp shell 24.

Figure 5:
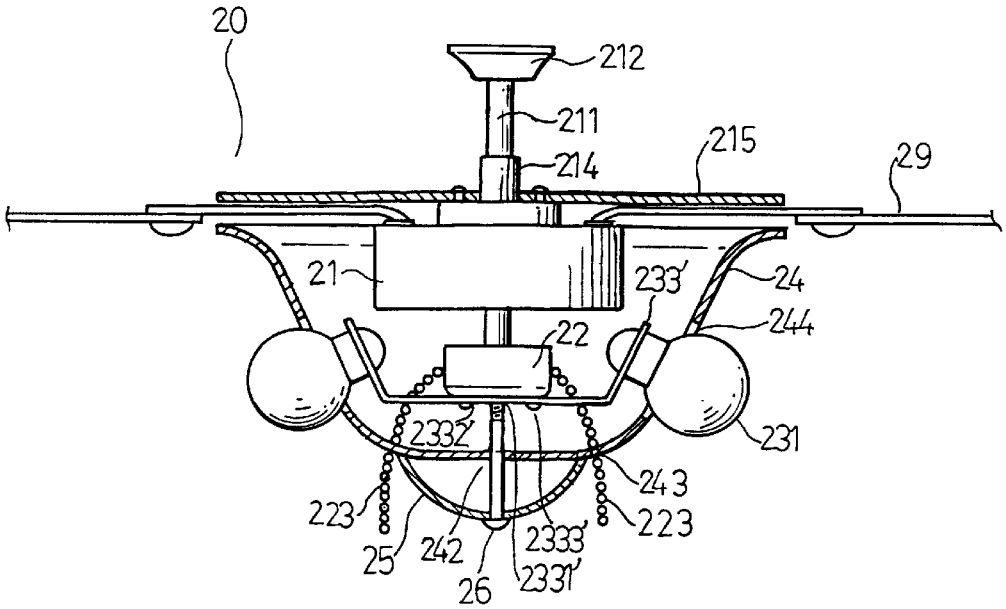
FIG. 5 is a partial cross sectional view of the ceiling fan as shown in FIG. 4.
Figure 4:
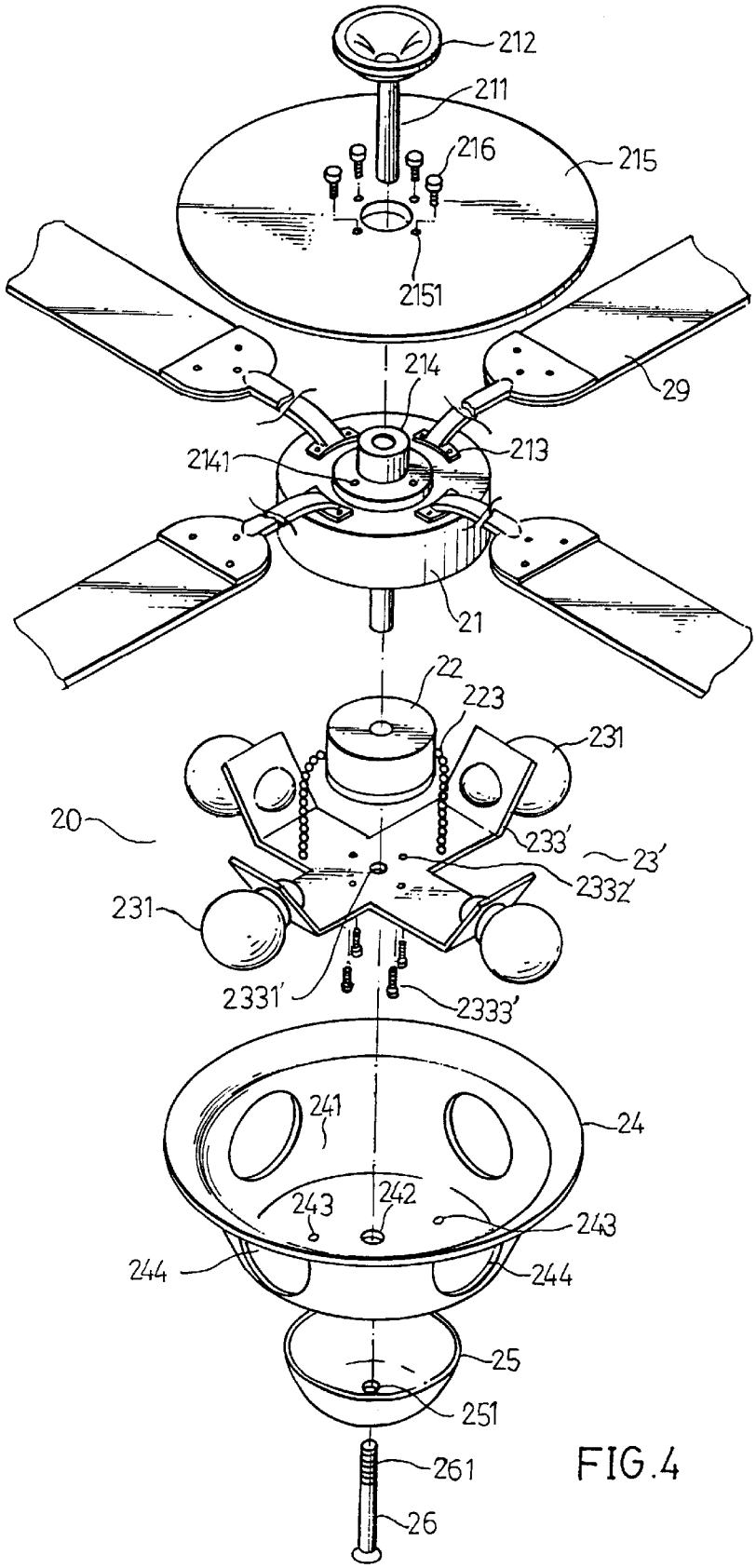
FIG. 4 is an exploded view showing another type of the present ceiling fan.

Please refer to FIGS. 4 and 5, the ceiling fan 20 includes a motor 21, a control box 22, a lamp shell 24, and a main lamp shell 25 which are similar to that shown in FIGS. 2 and 3. A frame 233' is a cross-shell having four ends bent upwards for securing the lamp bodies 231 of the lamps 23'. The lamp bodies 231 are protruded through the openings 244 of the lamp shell 24. The frame 233' includes a center hole 2331' for engaging with the connecting element 26 and includes four holes 2332' for engaging with screws 2333' which may secure the frame 233' to the control box 22.

Figure 6:
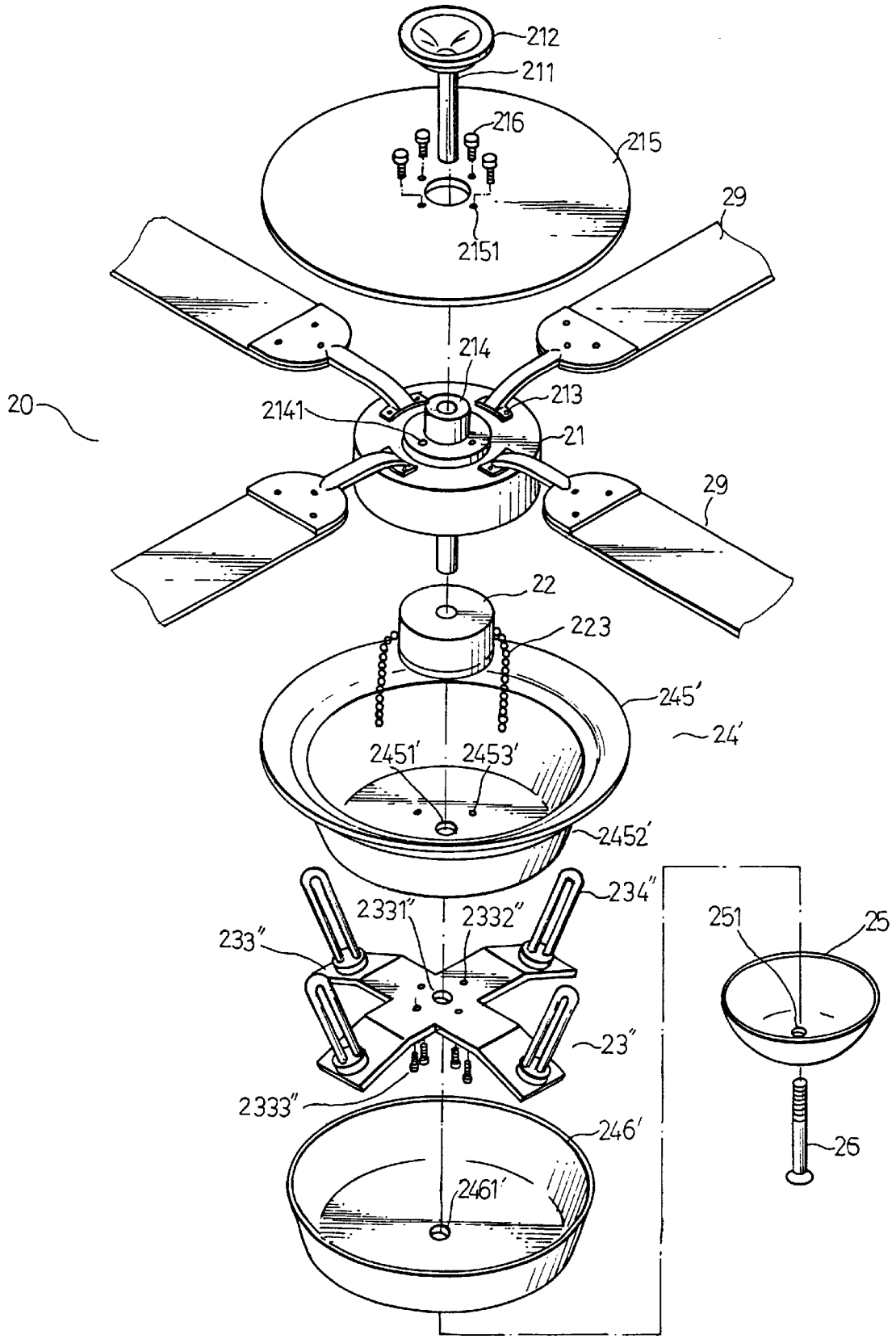
FIG. 6 is an exploded view showing a further type of the present ceiling fan.
Figure 7:
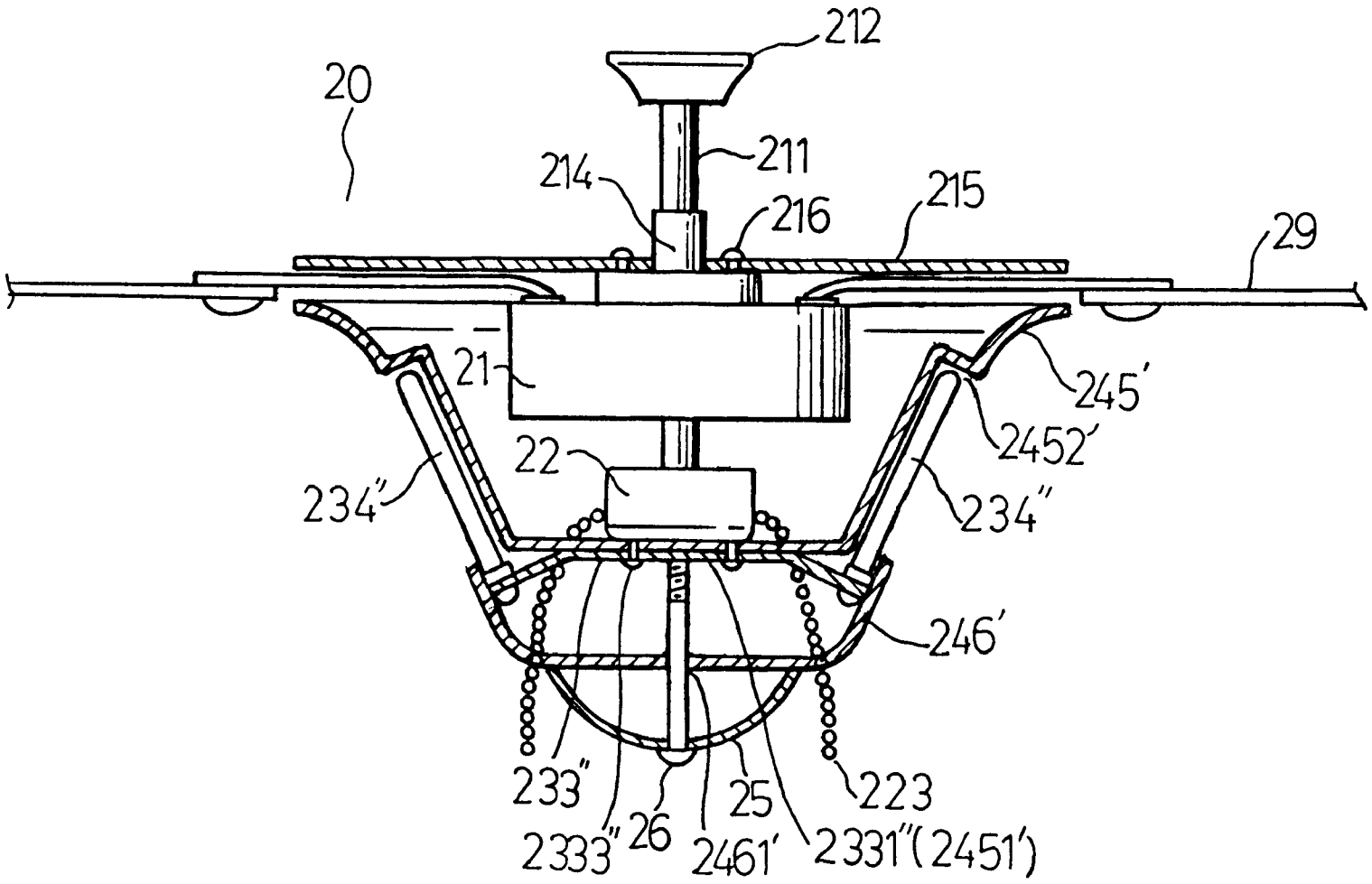
FIG. 7 is a partial cross sectional view of the ceiling fan as shown in FIG. 6.

Please refer to FIGS. 6 and 7, the ceiling fan 20 includes a motor 21, a control box 22 and a main lamp shell 25 which are similar to that shown in FIGS. 2 and 3. The lamp shell 24' includes an upper shell 245' and a lower shell 246' each having a center hole 2451' and 2461' for engaging with the connecting element 26. The upper shell 245' includes a concave circular space 2452'. A frame 233" is a cross-shell having four bent ends for securing the light tubes 234" of the lamps 23". The frame 233" includes a center hole 2331" for engaging with the connecting element 26 and includes four holes 2332" for engaging with screws 2333" which are engaged through the holes 2453' of the upper shell 245 and which may secure the frame 233" and the upper shell 245' to the control box 22.

The light tubes 234" are engaged around the concave circular space 2452' of the upper shell 245' and are engaged above the top of the lower shell 246'.

Figure 8:
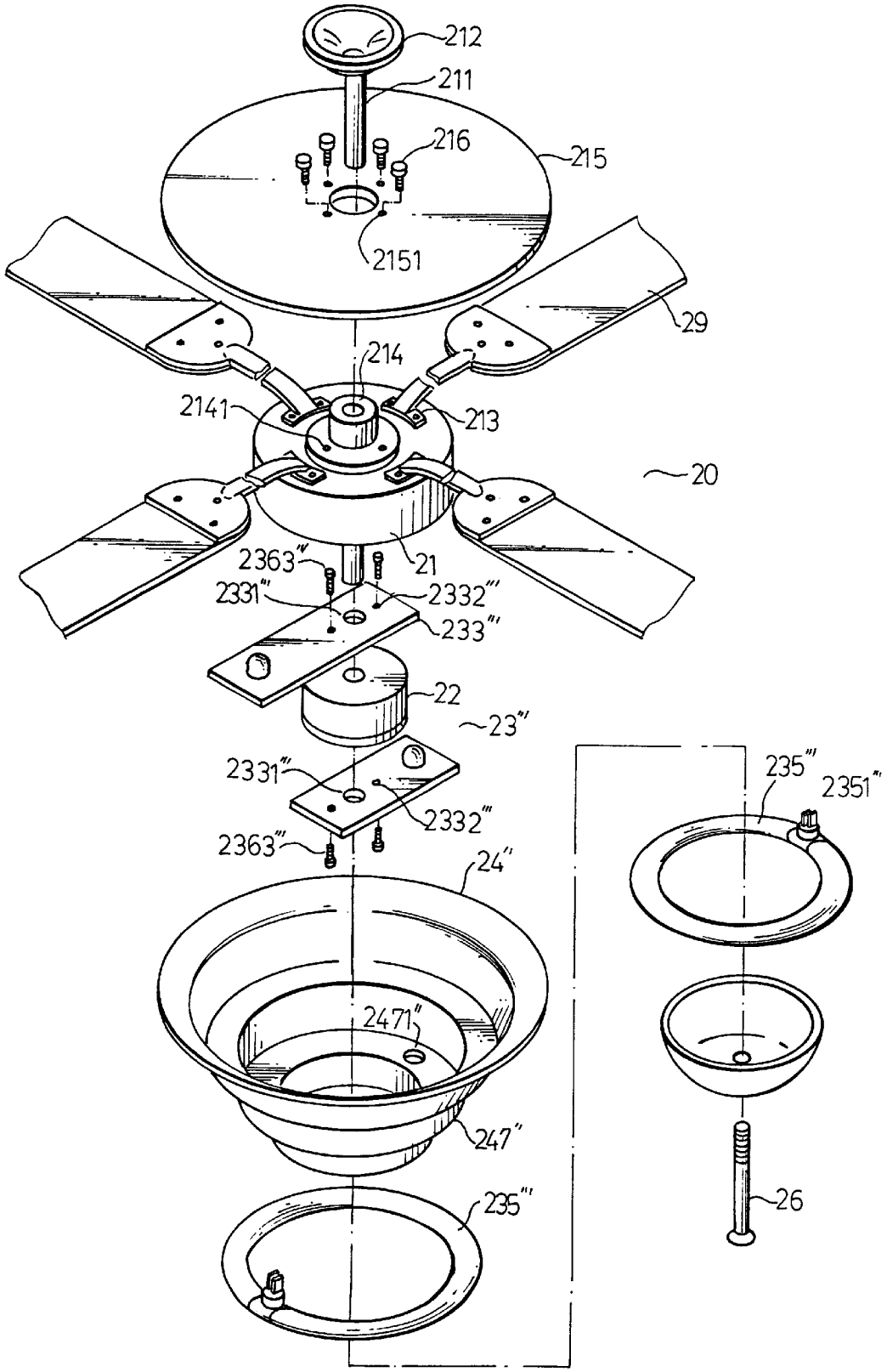
FIG. 8 is an exploded view showing a still further type of the present ceiling fan.
Figure 9:
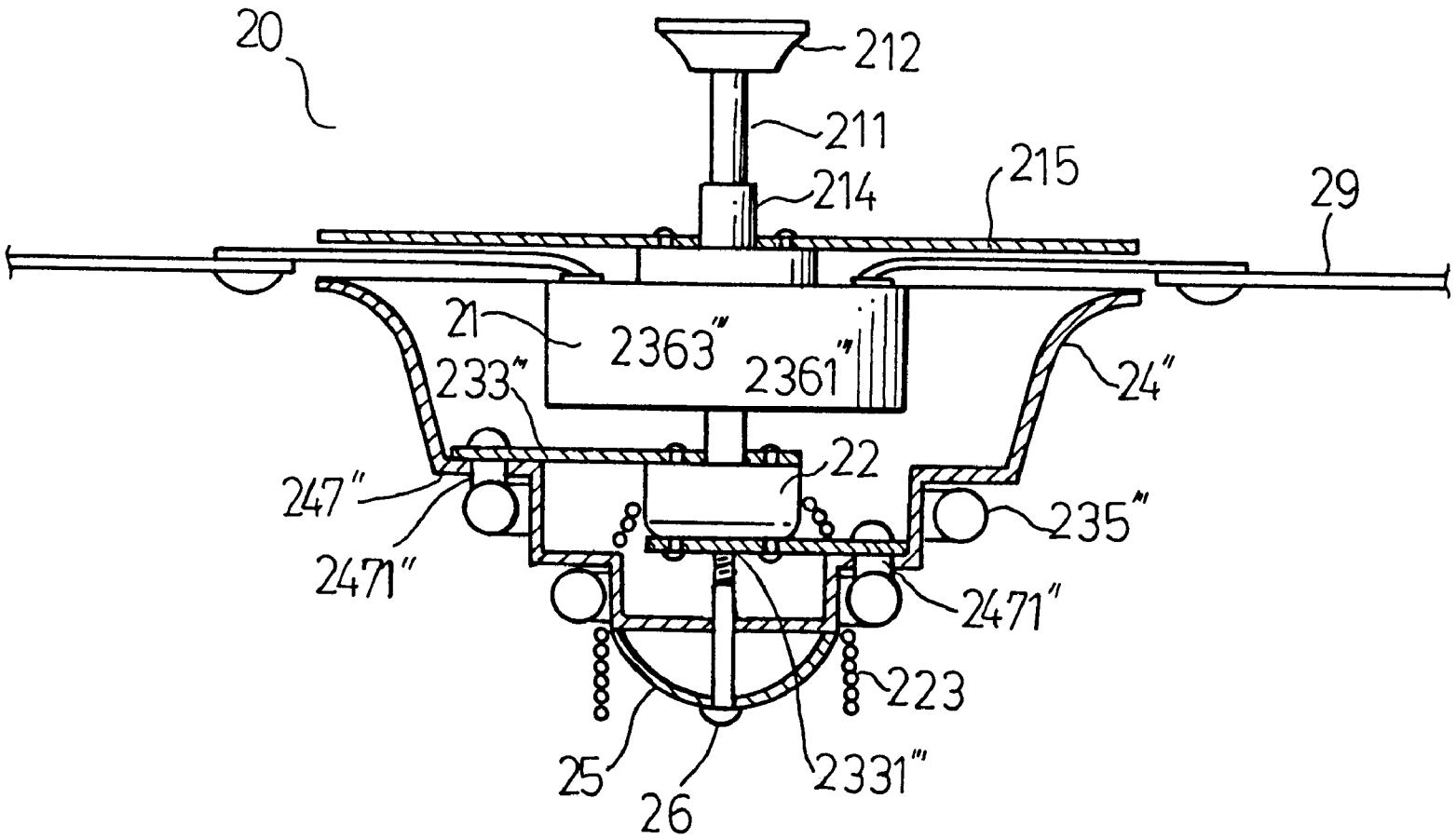
FIG. 9 is a partial cross sectional view of the ceiling fan as shown in FIG. 8.

In FIGS. 8 and 9, the lamp shell 24" includes a multi-circle step 247" having one or more annular shoulders each having an aperture 2471" for engaging with a lamp socket 2351'" of a circular light tube 235". Two frames 233'" of the lamp 23'" are plate-shape having a hole 2331'" and two holes 2332'" for engaging with screws 2363'" which may secure the frame 233'" to the top and the bottom of the control box 22. The sockets 2351'" are secured to the frames 233'".

Accordingly, the ceiling fan includes a motor 21 and a control box 22 engaged within the inner space of the lamp shell 24 such that the height of the ceiling fan is decreased.

What is claimed;:

1. A ceiling fan comprising:

a motor including a center having a shaft extended therethrough, said shaft including an upper end for securing to a ceiling and including a lower end extended downward of said motor, a control box secured to said lower end of said shaft, a plurality of fan leaves secured to said motor so as to be rotated by said motor, an upper shell and a lower shell each including a center hole, a frame including a cross shape having a plurality of ends, said frame including a center hole, means for securing said frame to said upper shell, a plurality of light tubes secured to said ends of said frame and engaged around said upper shell and located above said lower shell, a main lamp shell including a center hole, and a connecting element engaged through said center holes of said main lamp shell and said lower shell and said frame and said upper shell, and engaged with said control box so as to secure said main lamp shell and said lower shell and said frame and said upper shell to said control box, said motor and said control box being received in said upper shell.

2. A ceiling fan comprising:

a motor including a center having a shaft extended therethrough, said shaft including an upper end for securing to a ceiling and including a lower end extended downward of said motor, a control box secured to said lower end of said shaft and including an upper portion and a lower portion, a plurality of fan leaves secured to said motor so as to be rotated by said motor, a first lamp shell including a multi-circle step having at least two circular surfaces, said circular surfaces each including an aperture formed therein, two frame plates secured to said upper portion and said lower portion of said control box respectively, at least two circular light tubes engaged on said circular surfaces of said first lamp shell, a main lamp shell, and a connecting element engaged through said main lamp shell and said first lamp shell, and engaged with said control box so as to secure said main lamp shell and said first lamp shell to said control box, said motor and said control box being received in said first lamp shell.

* * * * *